US007068018B2

(12) United States Patent
Kanakubo

(10) Patent No.: US 7,068,018 B2
(45) Date of Patent: Jun. 27, 2006

(54) VOLTAGE REGULATOR WITH PHASE COMPENSATION

(75) Inventor: Yoshihide Kanakubo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 11/043,882

(22) Filed: Jan. 26, 2005

(65) Prior Publication Data

US 2005/0162141 A1 Jul. 28, 2005

(30) Foreign Application Priority Data

Jan. 28, 2004 (JP) ..... 2004-020394

(51) Int. Cl.
*G05F 1/44* (2006.01)
*G05F 1/56* (2006.01)

(52) U.S. Cl. ..... 323/274; 323/276

(58) Field of Classification Search ..... 323/274, 323/275, 276, 284
See application file for complete search history.

(56) References Cited

U.S. PATENT DOCUMENTS

| | | | | |
|---|---|---|---|---|
| 5,343,122 | A * | 8/1994 | Sugimori et al. | 315/209 R |
| 5,852,359 | A * | 12/1998 | Callahan et al. | 323/274 |
| 6,218,819 | B1 * | 4/2001 | Tiwari | 323/285 |
| 6,377,033 | B1 * | 4/2002 | Hsu | 323/274 |
| 6,441,594 | B1 * | 8/2002 | Connell et al. | 323/274 |
| 6,459,246 | B1 * | 10/2002 | Roo | 323/270 |
| 6,465,994 | B1 * | 10/2002 | Xi | 323/274 |
| 6,897,638 | B1 * | 5/2005 | Miyanaga et al. | 323/274 |

* cited by examiner

*Primary Examiner*—Bao Q. Vu
(74) *Attorney, Agent, or Firm*—Adams & Wilks

(57) ABSTRACT

The present invention provides a voltage regulator which has high-speed responsibility with a low consumption current, and which can stably operate with a low output capacity. The voltage regulator includes: a reference voltage circuit, a voltage division circuit, a differential amplifier, an output transistor, a MOS transistor which has a gate to which an output of the differential amplifier is connected, a constant current circuit connected between a drain of the MOS transistor and the ground, and parallel-connected resistor and capacitor for phase compensation are connected between the drain of the MOS transistor and a gate of the output transistor.

2 Claims, 2 Drawing Sheets

VOLTAGE REGULATOR WITH PHASE COMPENSATION

BACKGROUND OF THE INVENTION

1. Field of the Invention

The present invention relates in general to a voltage regulator, and more particularly to an improvement in responsibility of the voltage regulator and a stable operation of the voltage regulator.

2. Description of the Related Art

FIG. 4 is a circuit diagram of a conventional voltage regulator.

The voltage regulator includes a reference voltage circuit 10 for generating a reference voltage, bleeder resistors 11 and 12 with which an output voltage Vout of the voltage regulator is divided, a differential amplifier 20 for amplifying a difference between the reference voltage and a voltage appearing at a node between the bleeder resistors 11 and 12, and an output transistor 14 which is controlled in accordance with an output voltage of the differential amplifier 20.

When the output (reference) voltage of the reference voltage circuit 10 is assigned Vref, the voltage at the node between the bleeder resistors 11 and 12 is assigned Va, and the output voltage of the differential amplifier 20 is assigned Verr, if a relationship of Vref>Va is established, the output voltage Verr becomes low, while if a relationship of Vref≦Va is established, the output voltage Verr becomes high. When the output voltage Verr is low, since a gate to source voltage of the output transistor 14 is high and thus an ON resistance of the output transistor 14 becomes small, the output transistor 14 operates so as to increase the output voltage Vout. On the other hand, when the output voltage Verr is high, since the ON resistance of the output transistor 14 becomes large, the output transistor 14 operates so as to decrease the output voltage Vout. As a result, the output voltage Vout is held at a constant value.

In the case of the conventional voltage regulator, since the differential amplifier 20 is an amplifier circuit in a first stage, and a circuit constituted by the output transistor 14 and a load resistor 25 is an amplifier circuit in a second stage, a configuration of two-stage voltage amplification circuit is provided. A capacitor 22 for phase compensation is connected between the output of the differential amplifier 20 and a drain of the output transistor 14, and a frequency band of the differential amplifier 20 is narrowed by the mirror effect, thereby preventing the oscillation of the voltage regulator. As a result, the frequency band of the whole voltage regulator becomes narrow, and hence the responsibility of the voltage regulator becomes poor.

In general, when the responsibility of the voltage regulator is improved, it is necessary to widen the frequency band of the whole voltage regulator. However, when the frequency band of the whole voltage regulator is widened, it is necessary to increase a consumption current of the voltage amplifying circuit. In particular, when the voltage regulator is used for a battery of a portable device or the like, its operating time becomes shorter.

Also, when a three-stage voltage amplification is used, even if a consumption current is relatively small, the frequency band of the voltage regulator can be widened. However, because a phase is easily delayed by 180 degrees or more, the operation of the voltage regulator becomes unstable, which may cause oscillation thereof. Therefore, in the case of the three-stage voltage amplification, it is necessary to increase a capacitance value of the ceramic capacitor in order to reduce the phase at a zero point resulting from the load and an ESR (equivalent series resistance) of the capacitor.

[Patent Document 1] JP 4-195613 A (Page 3, FIG. 1)

SUMMARY OF THE INVENTION

In the conventional voltage regulator, in order to ensure the stability against oscillation, it is required to narrow the frequency band. Accordingly, there is a problem in that the responsibility is deteriorated. In addition, when the responsibility is improved, the consumption current is increased or the stability is deteriorated, so that a large capacitance is required for the output of the voltage regulator.

Therefore, in order to solve the above-mentioned conventional problems, an object of the present invention is to obtain a voltage regulator which has a preferable responsibility with a small consumption current and is stably operated even with a small output capacitance.

To solve the above problems, according to the present invention, there is provided a voltage regulator, including: a reference voltage circuit connected between a power supply and a ground; a voltage division circuit constituted by bleeder resistors for dividing an output voltage to be supplied to an external load; a differential amplifier for comparing an output of the voltage division circuit with an output of the reference voltage circuit to output a first signal; a MOS transistor having a gate to which an output of the differential amplifier is connected, and a grounded source; a constant current circuit connected between a drain of the MOS transistor and the ground; a resistor and a capacitor connected in parallel with each other in order to perform phase compensation, a second signal outputted from the drain of the MOS transistor being inputted to the parallel-connected resistor and capacitor; and an output transistor connected between the power supply and the voltage division circuit, an output of the parallel-connected resistor and capacitor being connected to a gate of the output transistor.

For the parallel-connected resistor and capacitor, a resistance value of the resistor is equal to or larger than 1 kΩ and a capacitance value of the capacitor is equal to or larger than 1 pF.

Though the voltage regulator of the present invention described above has a three-stage amplification circuit configuration, the phase compensation for the differential amplifier is carried out by the parallel-connected resistor and capacitor, whereby the high speed responsibility can be realized for the voltage regulator with low power consumption, and the voltage regulator can stably operate even with a low output capacity.

DESCRIPTION OF THE PREFERRED EMBODIMENTS

The voltage two-stage amplification is adopted for a differential amplifier 20 of a voltage regulator, and an output of the differential amplifier 20 is connected to an output transistor through parallel-connected resistor and capacitor, whereby a zero point formed by the resistor and a parasitic capacity of the output transistor is generated in a middle frequency band. Thus, the voltage regulator is excellent in responsibility, and stably operates even with a small output capacity.

First Embodiment

Figure 1:
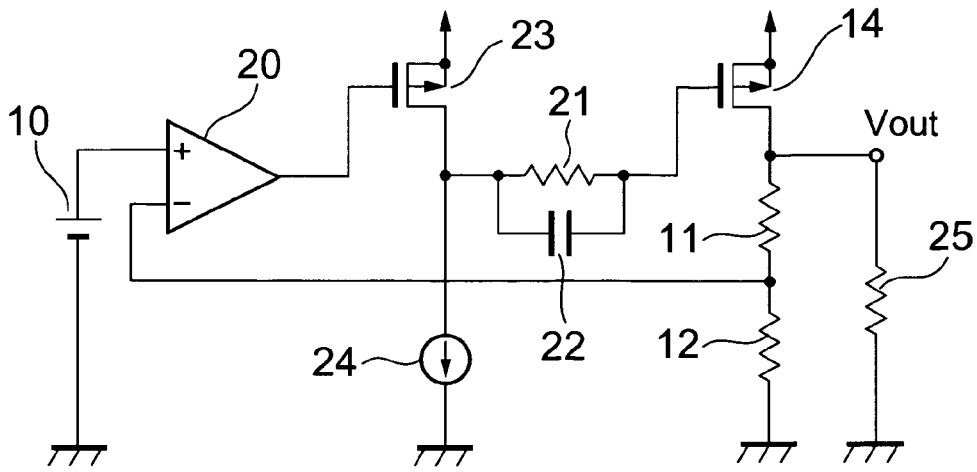
FIG. 1 is a circuit diagram of a voltage regulator according to a first embodiment of the present invention.

FIG. 1 is a circuit diagram of a voltage regulator according to a first embodiment of the present invention. The voltage regulator of the first embodiment includes a reference voltage circuit 10, bleeder resistors 11 and 12, a differential amplifier 20, a MOS transistor 23, parallel-connected resistor 21 and capacitor 22, an output transistor 14, and a load resistor 25.

Since the differential amplifier 20 is a voltage one-stage amplification circuit, and its output is amplified by the MOS transistor 23 constituting a common source amplification circuit, and by a common source circuit including the output transistor 14 and the load transistor 25, a three-stage amplification circuit is provided in terms of the voltage regulator. With the three-stage amplification, a GB product can be made large even with a low consumption current, and hence the responsibility of the voltage regulator can be enhanced. However, the voltage is easy to lag by 180° or more in the three-phase voltage amplification circuit, and hence the voltage regulator becomes easy to oscillate.

Figure 2:
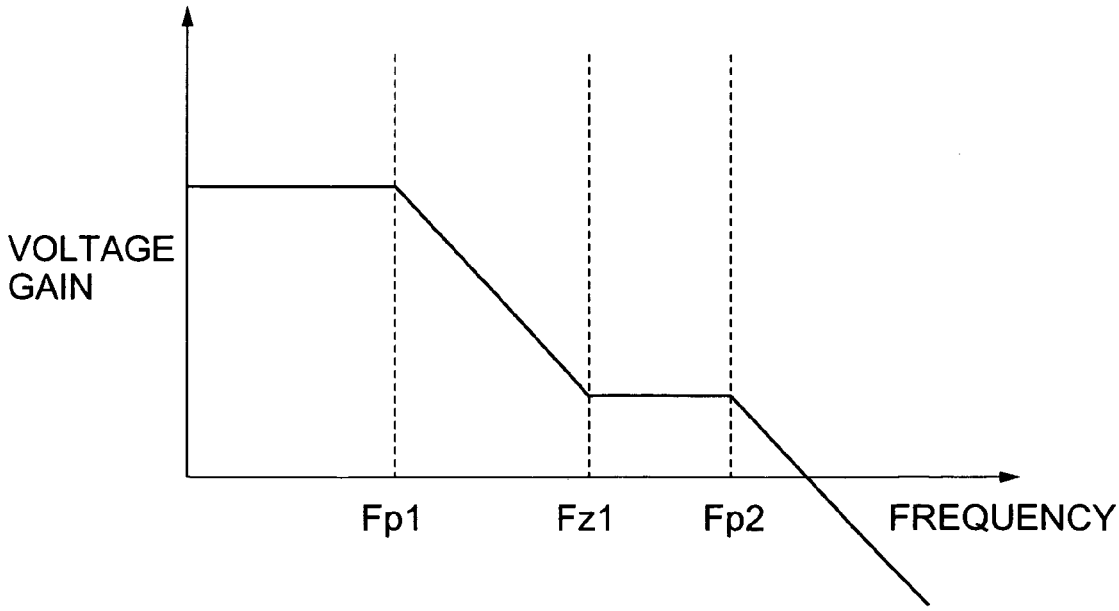
FIG. 2 is a graphical representation of an example of frequency characteristics of a voltage gain of a common source circuit constituted by a MOS transistor of the voltage regulator according to the first embodiment of the present invention.

Then, in order to prevent the oscillation, the phase is returned back to the original phase at a zero point formed by the parallel-connected resistor 21 and capacitor 22. FIG. 2 shows an example of the frequency characteristics of a voltage gain of the common source circuit constituted by the MOS transistor 23 in the voltage regulator of the present invention. The axis of abscissa represents a frequency expressed using logarithm, and the axis of ordinate represents decibel of a voltage gain. A first pole exists in the lowest frequency. Heretofore, this pole is referred to as a 1st pole, and a corresponding frequency is assigned Fp1. At and after the frequency Fp1, the voltage gain is attenuated at a rate of −6 dB/oct and the voltage gain begins to lag in phase by 90°. At a frequency to which the frequency is increased from the frequency Fp1, a first zero point exists. Hereinafter, the first zero point is referred to as a 1st zero point, and a corresponding frequency is assigned Fz1. At and after the frequency Fz1, since the voltage gain leads in phase by 90° for the frequency by the operation of the 1st zero point, the phase lag becomes zero again. Moreover, at and after the frequency Fp2, the voltage gain is attenuated at a rate of −6 dB/oct for the frequency, and the voltage gain begins to lag by 90°.

In FIG. 2, Equation (1) is established for a relationship among those frequencies:

$$Fp1>Fz1>Fp2 \quad (1)$$

That is, the frequency at which the voltage gain lags in phase is at and after the frequency Fp2. Consequently, since the frequency at which the phase lag occurs can be shifted to the high frequency band, the phase compensation can be carried out. For this reason, it is possible to enhance the stability of the whole voltage regulator.

A pole exists at a frequency depending on the output capacitance and the output resistance of the differential amplifier 20 shown in FIG. 1. This frequency is assigned Fp1st. In addition, in the common source circuit including the output transistor 14 and the load 25 shown in FIG. 1, a pole exists at a frequency depending on a resistance and the capacity of the load 25. This frequency is assigned Fp3rd. At each of the frequencies Fp1st and Fp3rd, the voltage gain begins to be attenuated for the frequency at a rate of −6 dB/oct, and starts to lag in phase by 90°. Since the two poles exist in the frequency, the voltage gain lags by 180° in total. However, when the frequency Fp1st is higher than the frequency Fp2, if in the frequency up to Fp2, two poles exist in the frequency band, and one zero point exists in the frequency band. Also, if the gain of the whole voltage regulator in the vicinity of Fp2 becomes zero, a phase margin is necessarily generated, and hence the voltage regulator can stably operate without oscillating.

In addition, the frequency Fz1 depends on the resistance value of the resistor 21 and the parasitic capacity of the output transistor 14. Here, it is supposed that the phase compensation is carried out by connecting a resistor and a capacitor for phase compensation between a gate and a drain of the output transistor 14. In the case of the voltage regulator, the output transistor 14 is larger in size than the normal transistor, and thus its parasitic capacity is large accordingly. For this reason, even if the phase compensation is tried to be carried out by inserting a capacitor between the gate and the drain of the output transistor 14, a capacitor having a capacitance value of several tens of pF is required since the capacitance value must be larger than that of the parasitic capacity.

However, in the present invention, since the resistor 21 is inserted in series with the gate of the output transistor 14, the phase compensation can be carried out by utilizing the parasitic capacity of the output transistor 14. For this reason, according to the present invention, as compared with the conventional phase compensation, the phase compensation can be carried out without adding a capacitor having a large capacitance value. Consequently, the whole voltage regulator can be configured in a small size, which leads to reduction of the cost. In addition, since the capacitance value of the parasitic capacity is several tens of pF, if only the resistance value of the resistor for phase compensation is equal to or larger than 1 kΩ, the zero point can be obtained at a frequency of equal to or lower than several MHz.

Second Embodiment

Figure 3:
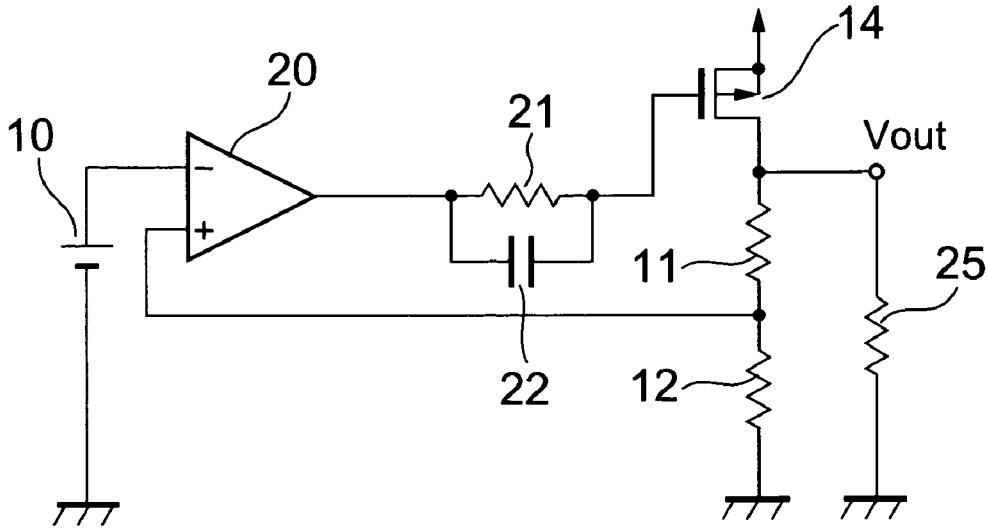
FIG. 3 is a circuit diagram of a voltage regulator according to a second embodiment of the present invention.
Figure 4:
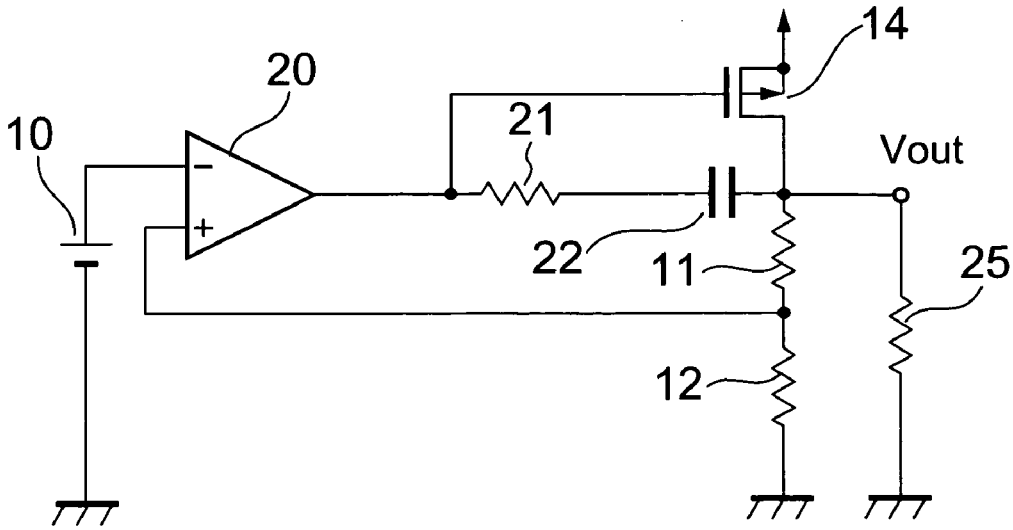
FIG. 4 PRIOR ART
FIG. 4 is a circuit diagram of a conventional voltage regulator.

FIG. 3 is a circuit diagram of a voltage regulator according to a second embodiment of the present invention. A reference voltage circuit 10, bleeder resistors 11, and 12, an output transistor 14, and a load resistor 25 are the same as those in the conventional voltage regulator shown in FIG. 4. A point of difference from the first embodiment is that there is no voltage amplification circuit in a second stage. Even in the case of the voltage regulator as shown in FIG. 3, insertion of a resistor for phase compensation makes it possible to obtain the same effects as those in the first embodiment. In the case of the conventional phase compensation having the two-stage voltage amplification, it is necessary to newly insert a resistor and a capacitor between the gate and the source of the output transistor. However, as in the second embodiment shown in FIG. 3, the resistor is inserted in series with the gate of the output transistor, whereby the phase compensation can be carried out without adding a capacitor having a large capacitance value for phase compensation.

While the insertion of the resistor for phase compensation has been described in the first and second embodiments, in FIGS. 1 and 3, the capacitor is inserted in parallel with the resistor. Then, this capacitor is required for the phase compensation. This capacitor is used in order to reduce the contribution of the resistor to the phase compensation in the higher frequencies. The present invention does not aim at inserting the capacitor for phase compensation, but aims at inserting the resistor in series with the gate of the output transistor. Thus, the present invention does not refer to such a configuration that the resistor and the capacitor are necessarily connected in parallel with each other.

What is claimed is:

1. A voltage regulator, comprising:

a reference voltage circuit connected between a power supply and a ground;

a voltage division circuit constituted by bleeder resistors for dividing an output voltage to be supplied to an external load;

a differential amplifier for comparing an output of the voltage division circuit with an output of the reference voltage circuit to output a first signal;

a MOS transistor having a gate to which an output of the differential amplifier is connected, and a source connected the power supply;

a constant current circuit connected between a drain of the MOS transistor and the ground;

a resistor connected in order to perform phase compensation, a second signal outputted from the drain of the MOS transistor being inputted to the resistor; and an output transistor connected between the power supply and the voltage division circuit, an output of the resistor being connected to a gate of the output transistor.

2. A voltage regulator, comprising:

a reference voltage circuit connected between a power supply and a ground;

a voltage division circuit constituted by bleeder resistors for dividing an output voltage to be supplied to an external load;

a differential amplifier for comparing an output of the voltage division circuit with an output of the reference voltage circuit to output a first signal;

a MOS transistor having a gate to which an output of the differential amplifier is connected, and a source connected the power supply;

a constant current circuit connected between a drain of the MOS transistor and the ground;

a resistor and a capacitor connected in parallel with each other in order to perform phase compensation, a second signal outputted from the drain of the MOS transistor being inputted to the parallel-connected resistor and capacitor; and an output transistor connected between the power supply and the voltage division circuit, an output of the parallel-connected resistor and capacitor being connected to a gate of the output transistor.

* * * * *